US010330130B2

(12) United States Patent
Dietzel et al.

(10) Patent No.: US 10,330,130 B2
(45) Date of Patent: Jun. 25, 2019

(54) VALVE FOR CONTROLLING A HYDROPNEUMATIC DEVICE FOR PRESSURE INTENSIFYING, AND HYDROPNEUMATIC DEVICE FOR PRESSURE INTENSIFYING WITH A VALVE

(71) Applicant: Tox Pressotechnik GmbH & Co. KG, Weingarten (DE)

(72) Inventors: Eberhard Dietzel, Weingarten (DE); Manfred Gresser, Baienfurt (DE); Albert Rankel, Schlier Oberankenreute (DE)

(73) Assignee: Tox Pressotechnik GmbH & Co. KG, Weingarten (DE)

( * ) Notice: Subject to any disclaimer, the term of this patent is extended or adjusted under 35 U.S.C. 154(b) by 490 days.

(21) Appl. No.: 14/146,133

(22) Filed: Jan. 2, 2014

(65) Prior Publication Data

US 2014/0109760 A1 Apr. 24, 2014

Related U.S. Application Data

(63) Continuation of application No. PCT/EP2012/002830, filed on Jul. 5, 2012.

(30) Foreign Application Priority Data

Jul. 7, 2011 (DE) ..... 10 2011 107 452

(51) Int. Cl.
*F15B 3/00* (2006.01)
*F15B 15/02* (2006.01)
*F15B 13/042* (2006.01)

(52) U.S. Cl.
CPC ..... *F15B 15/02* (2013.01); *F15B 3/00* (2013.01); *F15B 13/042* (2013.01)

(58) Field of Classification Search
CPC ..... F15B 3/00; Y10T 137/8671
See application file for complete search history.

(56) References Cited

U.S. PATENT DOCUMENTS 2,722,234 A * 11/1955 MacGeorge ..... F15B 13/0402 137/625.6
3,809,502 A * 5/1974 Henry ..... 417/225
(Continued)

FOREIGN PATENT DOCUMENTS

DE 20 2004 019 993 U1 4/2005
EP 1 705 411 A1 9/2006

OTHER PUBLICATIONS

International Search Report and Written Opinion (Application No. PCT/EP2012/002830) dated Jul. 9, 2013.

*Primary Examiner* — F Daniel Lopez
(74) *Attorney, Agent, or Firm* — Burr & Brown, PLLC

(57) ABSTRACT

A valve for controlling a hydropneumatic device for pressure intensifying having a working plunger and an intensifier plunger for pressure intensifying, the intensifier plunger being designed to move the working plunger hydraulically with a comparatively high transmission ratio on account of a pneumatic actuation, the valve having a differential plunger arrangement with a first plunger with a first active plunger face in a first pressure space and a second plunger with a second active plunger face in a second pressure space, the first plunger being coupled to the second plunger, the first pressure space being equipped with a first connector for, for example, a pneumatic return stroke space of the working plunger, and the second pressure space being equipped with a second connector for a pneumatic pressure source which differs from the return stroke space.

6 Claims, 4 Drawing Sheets

(56) References Cited

U.S. PATENT DOCUMENTS

| | | | | |
|---|---|---|---|---|
| 4,288,987 | A * | 9/1981 | Grullmeier | F15B 11/0325 60/560 |
| 4,401,293 | A * | 8/1983 | Rodewald | F16K 11/0712 137/625.69 |
| 5,409,040 | A * | 4/1995 | Tomlin | E21B 33/0355 137/625.66 |
| 5,782,268 | A * | 7/1998 | Kato et al. | 137/625.69 |
| 6,220,284 | B1 * | 4/2001 | Hayashi | F15B 13/0402 137/554 |
| 2005/0012058 | A1 | 1/2005 | Medina | |
| 2010/0264348 | A1 * | 10/2010 | Kinch | F15B 13/0402 251/321 |

* cited by examiner

VALVE FOR CONTROLLING A HYDROPNEUMATIC DEVICE FOR PRESSURE INTENSIFYING, AND HYDROPNEUMATIC DEVICE FOR PRESSURE INTENSIFYING WITH A VALVE

CROSS REFERENCE TO RELATED APPLICATIONS

This application is a continuation of International Application No. PCT/EP2012/002830 filed Jul. 5, 2012, which designated the United States, and claims the benefit under 35 USC § 119(a)-(d) of German Application No. 10 2011 107 452.3 filed Jul. 7, 2011, the entireties of which are incorporated herein by reference.

FIELD OF THE INVENTION

The invention relates to a valve for controlling a hydropneumatic device for pressure intensifying and to a hydropneumatic device for pressure intensifying having a valve.

BACKGROUND OF THE INVENTION

Hydropneumatic devices for pressure intensifying are used for the force-loaded movement of a die for various applications, in particular for joining by shearing and upsetting. Devices of this type have a working plunger which is moved hydraulically in a state by an intensifier plunger which is actuated pneumatically.

Up to the point at which the intensifier plunger becomes active, the working plunger is moved pneumatically with a small force. In order to position the switchover point between a non-intensified and intensified movement of the working plunger at the location, at which a great force is required at the working plunger, a valve is used which applies a working pressure to the intensifier plunger in a manner which is dependent on a pressure in a pneumatic return stroke space of the working plunger for the pneumatic return of the working plunger counter to a working stroke direction. The valve operates according to the back pressure process in relation to a differential plunger. The differential plunger has two plungers which are connected to one another and of which one has a greater plunger diameter than the other. That side with the greater plunger diameter of the differential plunger is connected to a return stroke space of the working plunger. The side with the smaller plunger diameter is connected structurally to a pressure source which provides the working pressure and is regularly used to actuate the intensifier plunger when the valve switches through. A waste air throttle with a non-return function is provided in a connecting line between the return stroke space of the working plunger and the valve, by way of which waste air throttle the waste air speed and therefore the switchover time of the valve can be set.

In a basic position, the return stroke space is loaded with pressure, as a result of which the valve is situated in a position, in which the intensifier plunger is pressureless. In the case of a switchover to a working stroke, the working plunger is loaded with a pneumatic working pressure (fast stroke), with the result that the working plunger moves in a working stroke direction.

If the movement of the working plunger is decelerated by an increased counterforce or comes to a standstill, the pressure drops in the return stroke space, it being possible for the speed of the pressure drop on the larger side of the valve slide to be set by adjustment of the waste air throttle.

If the pressure drops in front of the greater plunger diameter, this leads to the pressure at the smaller plunger diameter displacing the differential plunger and the valve switching. During this operation, a working pressure is switched through to a pressure space of the intensifier plunger, with the result that a movement of the working plunger then takes place with a great force in accordance with the transmission ratio of the intensifier plunger (power stroke). By way of the valve, it therefore always becomes possible, when the working plunger meets a counterforce and decelerates or sets its movement, to switch over to power stroke, in order to continue and to complete a desired working stroke with a considerably higher force.

The switching on and off of the air pressure can also be effected via externally actuated switching valves.

FIG. 2 shows a hydropneumatic pressure intensifier which is known from the prior art and has a convoluted travel of plunger elements only by way of example.

The following text with respect to FIG. 2 also applies in principle, however, to a pressure intensifier with a non-convoluted travel.

The pressure intensifier 1 comprises a pneumatically moved intensifier plunger 2 (called plunger in the following text), with a sealed plunger section 3 which is arranged displaceably in a pneumatic space (8*a*) (power stroke space) of a housing section 8 of the pressure intensifier 1. FIG. 2 shows the completely retracted position of the plunger 2, in which position pressure intensifying to a working plunger 4 has already taken place. The working plunger 4 is accommodated displaceably in a housing section 5 which is arranged in parallel.

In the stage which is shown, a plunger rod 2*a* of the plunger 2 is dipped into a high pressure hydraulic space 7 which is sealed by the plunger rod 2*a* via a seal (not shown). The high pressure hydraulic space 7 extends via a connecting line 7*a* into a hydraulic space section 7*b* in the housing section 5. The plunger is moved by pressure loading of the power stroke space 8*a*.

The power stroke space 8*a* is sealed via a wall 9 and seals (not shown) to the plunger rod 2*a* of the plunger 2 with respect to a further pneumatic space 12.

The pneumatic space 12 is defined firstly by the wall 9 and secondly by an accumulator plunger 13. The accumulator plunger 13 has sealing elements (not shown) which firstly seal the accumulator plunger 13 toward the plunger rod 2*a* of the plunger which runs through the accumulator plunger 13, and secondly ensure separation of the pneumatic space 12 from a low pressure hydraulic space 18.

In the completely retracted state of the plunger 2, hydraulic liquid can be pressed out of the low pressure hydraulic space 18 into the high pressure hydraulic space 7 by way of a pneumatic movement of the accumulator plunger 13, since the plunger rod 2*a* is then pulled out of the high pressure hydraulic space 7 to such an extent that an opening 6*a* through the seal is exposed.

By way of hydraulic liquid flowing into the high pressure hydraulic space 7, the working plunger 4 is displaced in the working direction 5 (see arrow 19).

The supply can take place at a comparatively high speed and is called fast stroke.

The working plunger 4 has a plunger section 4*a* which is sealed with respect to the high pressure space 7 or 7*b* and a plunger section 4*b* which lies opposite the former in the working direction (arrow 19). A hydraulic liquid volume is enclosed in a hydraulic space 20 between the plunger sections 4*a* and 4*b*.

The hydraulic space 20 is divided into a first region 21 and a second region 22 by a sealing section with respect to a plunger section 4*c*. A movement of the working plunger 4 can therefore take place only when the hydraulic fluid can flow over from the first region 21 and the second region 22 and vice versa. To this end, a regulating block (not shown) can be provided.

A movement sequence can be as follows: In a starting situation, the plunger 2 is retracted completely in FIG. 2 to the left-hand edge wall 8*b* of the power stroke space 8*a*. Via the accumulator plunger 13 which can be actuated pneumatically by compressed air loading of the pneumatic space 12, first of all hydraulic liquid is displaced from the low pressure hydraulic space 18 into the high pressure hydraulic space 7. As a result, a comparatively rapid stroke of the working plunger 4 can be brought about (fast stroke) by hydraulic fluid flowing over via the connecting line 7*a* into the hydraulic space section 7*b*.

To this end, the hydraulic block (not shown) permits, for example, a corresponding rapid equalization of hydraulic liquid from the second region 22 into the first region 21.

In this phase, the working plunger 4 is under low pressure.

From a predefined displacement travel of the working plunger 4, the latter is to be loaded with high pressure. To this end, the plunger rod 2*a* of the plunger 2 enters into the high pressure hydraulic space 7 through the opening 6*a* by way of pneumatic loading of the power stroke space 8*a*. This operation is initiated (see below) by a valve for controlling the power stroke (power stroke valve). As a result of the ratio of the active cross sections of the plunger section 3 with respect to the plunger rod 2*a*, an enormous pressure intensification takes place into the hydraulic liquid in the high-pressure hydraulic space 7, with the result that the working plunger can be extended further with great force by way of the hydraulic liquid which is under high pressure, depending on how far the plunger dips into the high pressure hydraulic space 7 (power stroke).

It is also necessary in this movement that hydraulic liquid can flow over from the second region 22 into the first region 21 of the hydraulic space 20.

For a return movement of the working plunger 4, the regulating block (not shown) can be configured in such a way that a largely free flow of hydraulic liquid from the first region 21 into the second region 22 is possible. For the return movement, a pneumatic space 25 (return stroke space) is loaded with compressed air and, in the same way, the plunger 2 is moved back pneumatically over the pneumatic space 8, with the result that hydraulic liquid from the high pressure hydraulic space 7 can flow back into the low pressure hydraulic space 18 as a result of pressure loading in the pneumatic space 25.

As a result, the accumulator plunger 13 is also moved in the direction of the wall 9.

FIG. 3 shows a valve 26 which is known from the prior art for controlling the power stroke (power stroke valve) with a displaceably mounted differential plunger 27 with a plunger 28 with a large plunger face 29 and a plunger 30 with a small plunger face 31.

The plunger 28 moves in a pressure space 32 and the plunger 30 moves in a pressure space 33. FIG. 3 shows the position of the differential plunger 27, in which it is displaced as far as possible to the right.

In this position, there is a connection of an outlet 34, to which the power stroke space is connected, through the power stroke valve 26 to an outlet 35, via which air can escape via a baffle 36. The pressure space 33 is connected via an inlet 37 to a power stroke line (not shown). The function of the power stroke valve will be explained in the following text with reference to FIG. 4. Here, the connection to a pressure intensifier is shown in a very diagrammatic manner, for example to a pressure intensifier according to FIG. 2.

A changeover from fast stroke to power stroke takes place automatically when, during the fast stroke, the working plunger 4 encounters resistance at any desired point of the stroke and comes to a standstill. The side of the differential plunger 27 with the plunger 28 with a larger plunger face is connected via a pneumatic connection 39 at the connector 38 and a waste air throttle 40 to the return stroke space 25 of the pressure intensifier 1. The side of the differential plunger with the plunger 30 with the smaller plunger face 31 is connected via the connector 37 to a fast stroke line 41 of the pressure intensifier 1.

In the basic position of the pressure intensifier, the working plunger 4 and the plunger 2 and the accumulator plunger 13 are situated in a return stroke position, in which a return stroke pressure prevails in the return stroke space 25 via a return stroke line 42, which return stroke pressure loads the large plunger face 29 with pressure via the connection 39, the waste air throttle 40, the inlet 38 and the pressure space 32 and displaces the differential plunger 27 in the opposite direction to the pressure space 32.

In the case of a switchover into a fast stroke, the fast stroke pressure prevails at the small plunger face 31 of the plunger 30 via the fast stroke line 41, the inlet 37 and the pressure space 33. The working plunger then moves in the direction of the arrow 19 (see also FIG. 4).

The air which is enclosed in the return stroke space 25 cannot escape quickly enough via the return stroke line 42, with the result that there is a correspondingly high pressure in the pressure space 32 via the pneumatic connection 39 and the inlet 38, as a result of which the differential plunger 27 remains in the position which is shown in FIG. 3 despite a pressure in the pressure space 33, in which position the power stroke space 8*a* is still pressureless. If, however, the working plunger 4 encounters resistance and comes to a standstill, the pressure in the pressure space 32 drops via the waste air throttle 40, with the result that the power stroke valve 26 switches, by the differential plunger 27 moving into the pressure space 32 to such an extent that a connection of the inlet 37 to the outlet 34 takes place, as a result of which the power stroke space 8*a* is loaded with the fast stroke pressure or working pressure. The power stroke begins at this moment. The switchover time can be regulated via the waste air throttle 40, depending on how fast the enclosed air in the pressure space 32 can escape. If the pressure intensifier 1 is switched into the return stroke, the air escapes immediately from the fast stroke side of the power stroke valve 26 and the air which flows in onto the larger plunger face 29 brings about a switchover of the power stroke valve 26 substantially without delay back into the basic position.

The waste air throttle can also be replaced by a pneumatic switching valve for any desired switching through of the power stroke.

SUMMARY OF THE INVENTION

The invention is based on the object of improving a hydropneumatic device for pressure intensifying with a valve for controlling the device in such a way that a broadened field of use is made possible for the hydropneumatic device for pressure intensifying.

The invention proceeds from a valve for controlling a hydropneumatic device for pressure intensifying, which hydropneumatic device has a working plunger and an intensifier plunger for pressure intensifying. The intensifier plunger is designed to move the working plunger hydraulically with a comparatively high transmission ratio on account of pneumatic actuation, the valve having a differential plunger arrangement with a first plunger with a first active plunger face in a first pressure space and a second plunger with a second active plunger face with a second pressure space. The first plunger is coupled to the second plunger. The first active plunger face is preferably larger than the second active plunger face. The first pressure space is equipped with a first connector for a pneumatic control pressure, in particular return stroke space of the working plunger or an external switching connector, and the second pressure space is equipped with a second connector for a pneumatic pressure source which differs from the control pressure. In the case of a predefined pressure difference, the valve switches during a working stroke of the working plunger and the intensifier plunger is loaded with a working pressure.

The core of the invention then lies in the fact that a third plunger with a third active plunger face is provided, which third plunger is coupled to the second plunger and has a third pressure space which can be loaded via a third connector with a pneumatic pressure source, and that the valve is such that the valve switches in the case of a predefined pressure difference between the first and third pressure space and supplies any intensifier plunger which is connected with the pressure in the second pressure space.

The intensifier plunger is therefore moved by way of the pressure in the second pressure space and initiates the power stroke.

The construction according to the invention has first of all the advantage that the switching of the valve by the third pressure space can take place independently of a pressure in the second pressure space. It is therefore possible to supply substantially any desired pressures to the second pressure space which is switched through to the intensifier plunger, without influencing the switching behavior of the valve. In this way, the force of the intensifier plunger can be set in a broad range by way of different pressures. In contrast, the switching behavior of the valve is defined by the differential pressure between the first and third pressure space. The pressure in the third pressure space can be set, in relation to the second pressure space, to a level which makes a desired switching behavior possible; for example, to a maximum available supply pressure. In a corresponding way, it is necessary only once to set a waste air throttle between the first pressure space and the return stroke space in such a way that a back pressure during the movement of the working plunger in the return stroke space behaves, in relation to a pressure in the third pressure space, in such a way that the valve always switches at the same desired point and supplies the intensifier plunger with the provided working pressure.

If the pressure in the second pressure space to the intensifier plunger is changed, this therefore has no effect on the switching behavior, as would be the case in the prior art when a pressure regulation is made discernible immediately by a changed pressure in the second pressure space which is responsible for the switching behavior in the prior art. In this case, the waste air throttle between the first pressure space and the return stroke space would have to be adapted, in order to make the valve switch through at the same point in the case, for example, of a reduced pressure which is switched through to the intensifier plunger.

According to the invention, without influencing the switching behavior, a pressure regulator can be provided in the supply line to the second connector for the second pressure space, by way of which pressure regulator the power stroke can be set as stipulated via the intensifier plunger.

A pressure regulator of this type can be accommodated in the power stroke valve or at any other desired point, for example, in a switch cabinet.

A proportional valve, for example, can be used as pressure regulator, which proportional valve is arranged in a line between the second pressure space and a pressure space for the intensifier plunger. However, other pressure regulating units are also conceivable.

In a further particularly preferred refinement of the invention, a connecting line is provided between the second and the third pressure space, which connecting line can be closed. This affords the advantage that the valve according to the invention is likewise available for a conventionally known use, by the connecting line between the second and third pressure space remaining open, but the connector of the third pressure space to the outside being closed. If, in contrast, work is to be carried out with a reduced working pressure for the intensifier plunger with a constant, for example maximum, supplying pressure for the switching behavior, the connecting line is closed, whereby a high switching pressure can be applied at the third connector and the second connector is supplied with a reduced pressure, for example by a pressure regulator. It is likewise possible to also connect a pneumatic continuous pressure supply to the second connector in safety-relevant controllers, and to switch the continuous pressure supply through via a switched inlet to the intensifier plunger.

In a further preferred embodiment, the connecting line between the second and third pressure space can be closed by a screw element, for example, by it being screwed into the connecting line between the lines of the second and third connector.

In order to realize a simple coupling between the second and third plunger, it is preferred if the third plunger is configured such that it can be clipped into the second plunger. As a result, it is possible that the second plunger can also be used in systems, in which a third plunger is not provided. A provided latching possibility for the third plunger does not disrupt the function of the second plunger. However, it is also conceivable that the third plunger is configured in one piece with the further plunger, optionally with all plungers.

A further essential aspect of the invention lies in the fact that a third connector is provided which can be loaded with a pressure source, and that the valve is such that the valve switches in the case of a predefined pressure difference between the first and second pressure space, and a connected intensifier plunger is supplied with the pressure of the pressure source which lies at the third connector.

In this embodiment, a third switchable passage is provided in an unchanged differential plunger arrangement, which third switchable passage can be used for variable pressures at the intensifier plunger. The switching behavior of the valve is therefore likewise kept independent of the pressure which is set at the intensifier plunger. This is because the second pressure space can be loaded with the full supply pressure. In a corresponding way, as in the case of the first embodiment of the invention, a pressure-regulated line can be connected, for example, to the third connector, with the result that the pressure at the intensifier plunger, if its pressure space is connected, can be set freely in a broad range in accordance with a pressure regulation of this type.

BRIEF DESCRIPTION OF THE DRAWINGS

A plurality of exemplary embodiments of the invention are shown in the drawings and will be explained in greater detail in the following text with the specification of further advantages and details.

DETAILED DESCRIPTION OF THE INVENTION

Figure 1:
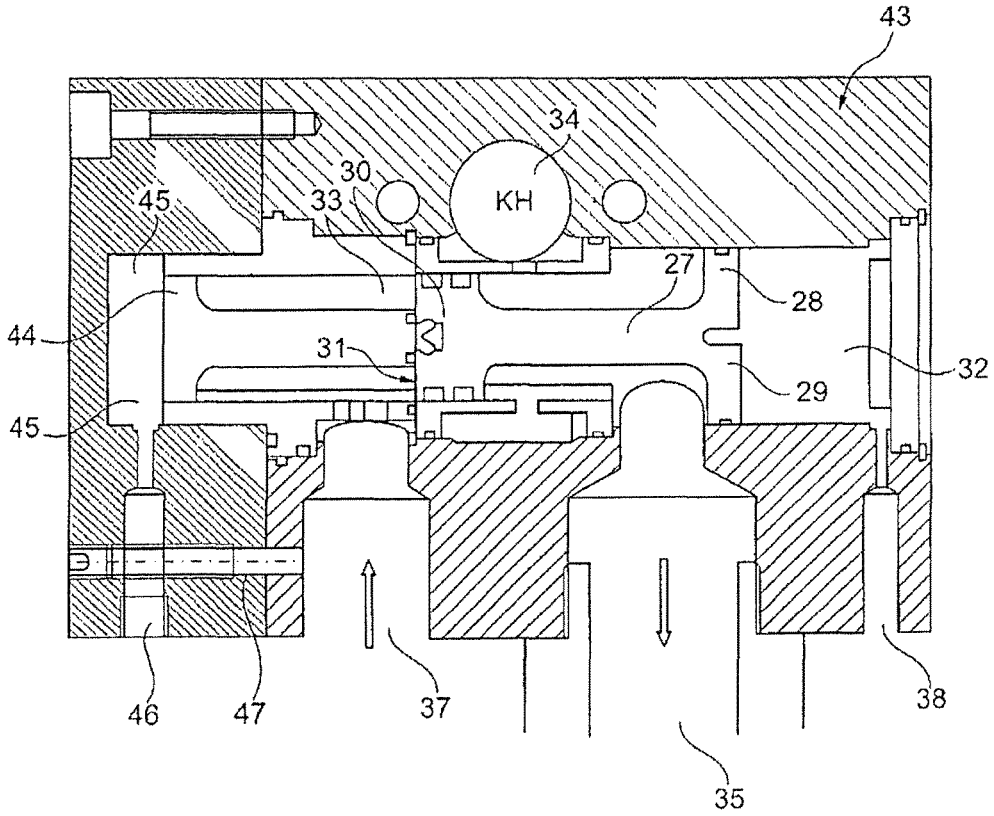
FIG. 1 shows a diagrammatic longitudinal cross-sectional view of a power stroke valve according to the present invention.
Figure 2:
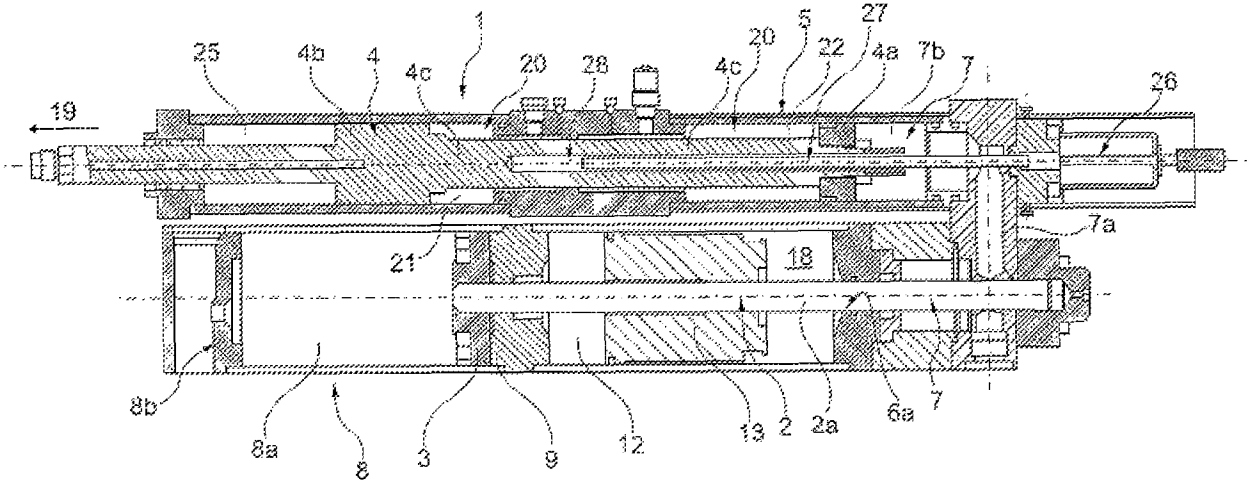
Fig. 2 PRIOR ART
FIG. 2 is a one-sectional view along the longitudinal axis through a hydropneumatic pressure intensifier with a convoluted stroke travel according to the prior art.
Figure 3:
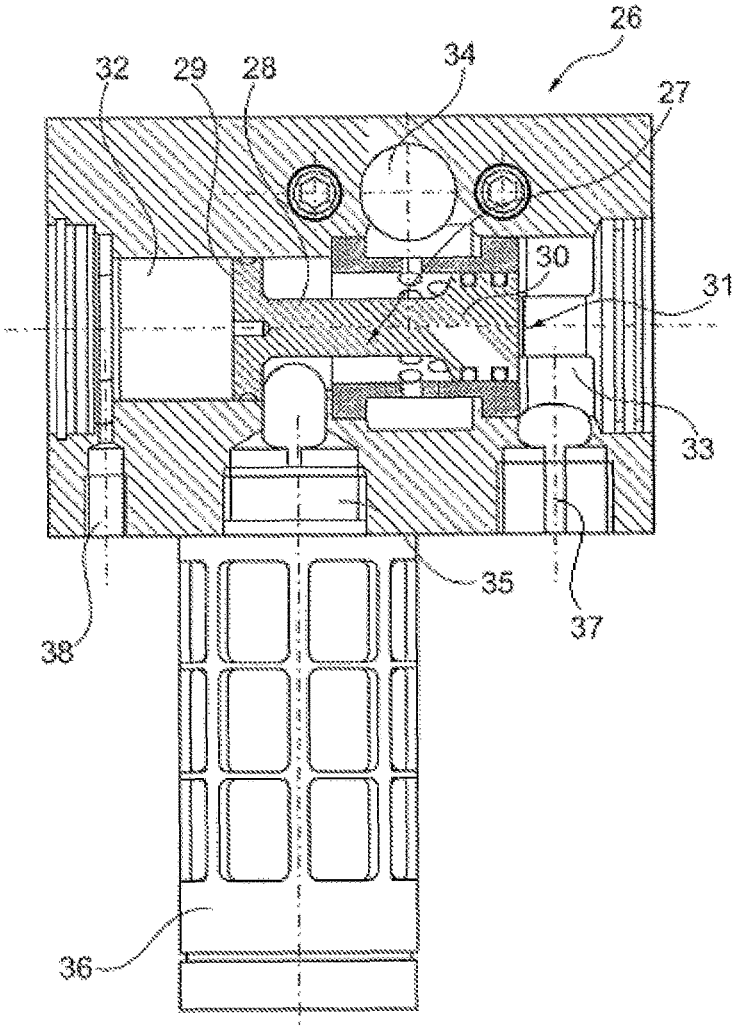
Fig. 3 PRIOR ART
FIG. 3 shows a cross-sectional view through a valve which is known from the prior art for controlling the power stroke (power stroke valve)
Figure 4:
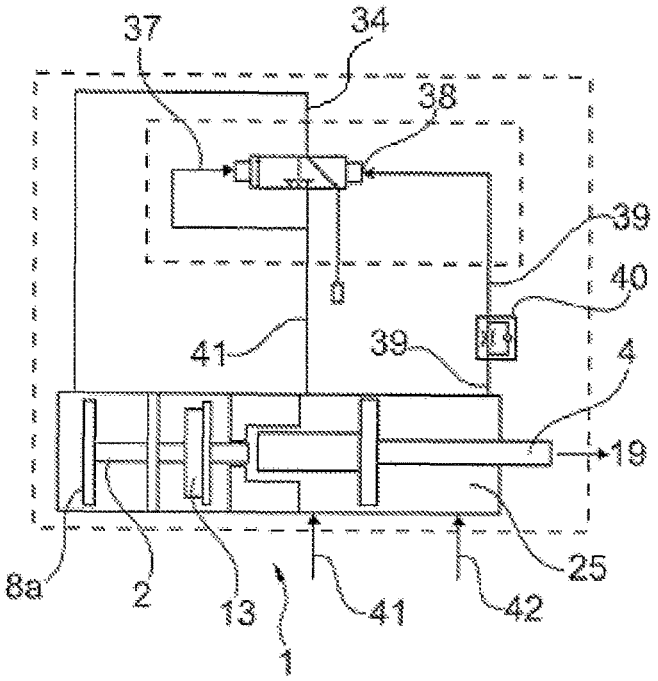
Fig. 4 PRIOR ART
FIG. 4 shows a basic circuit of a hydropneumatic pressure intensifier with a valve for controlling the power stroke.

FIG. 1 shows a power stroke valve 43 according to the invention. Identical elements as in the power stroke valve 26 are provided with identical designations.

The central element of the power stroke valve is the differential plunger 27. The differential plunger 27 has a small plunger 30 with a small plunger face 31 and a large plunger 28 with a large plunger face 29. The plunger is mounted displaceably, as a result of which the plunger 28 moves in a pressure space 32 and the plunger 30 moves in a pressure space 33. FIG. 1 shows the position of the differential plunger 27, in which it is moved as far as possible to the left. In the connected state, the pressure space 32 is connected to the return stroke space 25 by the inlet 38.

Furthermore, as in the power stroke valve 26, an outlet 35 to a baffle (not shown) and an outlet 34 to the power stroke space are provided. Moreover, an inlet 37 exists which is supplied with a working pressure which is then applied to the power stroke space 8*a* via the outlet 34, in the case of a corresponding switching position of the power stroke valve 43. To this extent, the power stroke valve 43 has the same functional components as the power stroke valve 26.

In contrast to the power stroke valve 26, the plunger 30 with the small plunger face 31 is coupled to a further plunger 44 which preferably has the same plunger face as the plunger 30 and moves in a pressure space 45. FIG. 1 shows the position as far as possible to the left.

The pressure space 45 can be loaded with control air via an inlet 46. There is a connection 47 between the inlet 37 and the inlet 46.

For the case where the inlet 46 is closed by way of a closure plug and the connection 47 between the inlet 37 and the inlet 46 is opened, the power stroke valve 43 operates exactly in the same way as the power stroke valve 26, the plunger 44 moving in parallel with the differential plunger 27 or the smaller plunger 30.

However, the additional plunger 44 results in an additional functionality.

If the connection 47 between the inlet 46 and the inlet 37 is closed, for example by way of a screw element, there is the possibility to use the inlet 46 as a separate inlet for control.

The additional inlet 46 can advantageously be used when, in the case of feeding to the inlet 37 for loading the power stroke space 8*a* with compressed air, a pressure regulator is used, in order for it therefore to be possible to set the power during the power stroke as desired.

In this case, a supply pressure without pressure reduction is applied to the inlet 46 as control inlet, whereas a pressure-regulated supply takes place via a pressure regulator at the inlet 37. The influence of a regulated pressure for the power stroke space 8*a* is therefore independent of the switching behavior of the power stroke valve 43. This is because the switching behavior is determined by the control pressure at the inlet 46 which regularly lies above the regulated pressure at the inlet 37. The pressure which is provided for the power stroke space 8*a* can therefore be selected as desired in principle, in particular can lie considerably below pressure values, for which the conventional power stroke valve would no longer function reliably. Moreover, a change in the power stroke space supply pressure has no effects with regard to setting of the waste area throttle 40. The pressure regulator for supplying the power stroke space can therefore be positioned at any desired point, for example, in a remote switch cabinet or at another point which is favorable for the user.

Setting of a pressure for the power stroke space can therefore be provided in a broad range elegantly without sacrificing conventional functionality, without a switching behavior of the switching point between fast stroke and power stroke being impaired.

Furthermore, it is possible to connect a pneumatic continuous pressure supply to the connector 37 and to switch it via an externally connected valve at the connector 46 when the connecting line 47 is closed.

LIST OF DESIGNATIONS

1 Hydropneumatic pressure intensifier
2 Intensifier plunger (plunger)
2*a* Plunger rod
3 Plunger section
4 Working plunger
4*a* Plunger section
4*b* Plunger section
4*c* Plunger section
5 Housing section
6*a* Opening
7 High pressure hydraulic space
7*a* Connecting line
7*b* Hydraulic space section
8 Housing section
8*a* Pneumatic space (power stroke space)
8*b* Edge wall
9 Wall
12 Pneumatic space
13 Accumulator plunger
18 Low pressure hydraulic space
19 Arrow
20 Hydraulic space
21 First region
22 Second region
25 Pneumatic space (return stroke space)
26 Power stroke valve
27 Differential plunger
28 Plunger
29 Plunger face
30 Plunger
31 Plunger face
32 Pressure space
33 Pressure space
34 Outlet
35 Outlet
36 Baffle

37 Inlet
38 Inlet
39 Pneumatic connection
40 Waste air throttle
41 Fast stroke line
42 Return stroke line
43 Power stroke valve
44 Plunger
45 Pressure space
46 Inlet
47 Connection

What is claimed:

1. A valve for controlling a hydropneumatic device for pressure intensifying having a working plunger and an intensifier plunger for pressure intensifying, the intensifier plunger being adapted to move the working plunger hydraulically with a high transmission ratio by pneumatic actuation, the valve comprising:

a housing having a plunger section, the plunger section having first and second ends defining an axis therebetween;

a slidable plunger rod coaxially mounted in the plunger section and reciprocally movable in a path of travel defined in a direction between the first and second ends of the plunger section;

a differential plunger arrangement including a first plunger, mounted on the slidable plunger rod, having a first active plunger face and a rear surface, the first plunger face is facing a first pressure space defined at the first end of the plunger section, a second plunger, mounted on the slidable plunger rod and coaxially coupled to the first plunger, having a second active plunger face and a rear surface, the second plunger face is facing a second pressure space, the coaxially mounted first and second plungers being movable in the path of travel between a first position wherein the first plunger face facing the first pressure space is located proximate the first end, and the second plunger face facing the second pressure space is located at a first distance from the first end, and a second position wherein the first plunger face facing the first pressure space is spaced away from the first end, and the second plunger face facing the second pressure space is at a second distance from the first end, the second distance being greater than the first distance, the first pressure space being equipped with a first connector for a first pneumatic control pressure, and the second pressure space being equipped with a second connector for a second pneumatic control pressure, whereby the second pneumatic control pressure is selectively different from the first pneumatic control pressure, and a third plunger having a third active plunger face facing a third pressure space and a rear surface facing the second pressure space, the third plunger being coaxially coupled to the second plunger, the third pressure space defined at the second end of the plunger section, and adapted to be loaded, via a third connector, with a third pneumatic control pressure;

a connecting line in the housing, which is between the third pressure space and the second pressure space, such that the third connector is connected to the second connector via the connecting line in the housing; and a screw element screwed into the connecting line prevents fluid communication between the third connector and the second connector;

whereby when a pressure difference between the first and third pressure space occurs, the valve switches and supplies the second pneumatic control pressure; and wherein the third plunger face of the third plunger has substantially the same outer diameter as the second plunger face of the second plunger.

2. The valve as claimed in claim 1, wherein the third plunger is clipped into the second plunger.

3. The valve as claimed in claim 1, wherein the third plunger is configured in one piece with the second plunger.

4. A hydropneumatic device for pressure intensifying, the hydropneumatic device comprising:

a working plunger;

an intensifier plunger, the intensifier plunger being adapted to move the working plunger hydraulically with a high transmission ratio by pneumatic action; and a valve for controlling the hydropneumatic device, the valve comprising:

a housing having a plunger section, the plunger section having first and second ends defining an axis therebetween;

a slidable plunger rod coaxially mounted in the plunger section and reciprocally movable in a path of travel defined in a direction between the first and second ends of the plunger section;

a differential plunger arrangement including a first plunger, mounted on the slidable plunger rod, having a first active plunger face and a rear surface, the first plunger face is facing a first pressure space defined in the first end of the plunger section, a second plunger, mounted on the plunger rod and coaxially coupled to the first plunger, having a second active plunger face and a rear surface, the second plunger face is facing a second pressure space, the coaxially mounted first and second plungers being movable in a path of travel between a first position wherein the first plunger face facing the first pressure space is located proximate the first end, and the second plunger face facing the second pressure space is located at a first distance from the first end, and a second position wherein the first plunger face facing the first pressure space is spaced away from the first end, and the second plunger face facing the second pressure space is at a second distance from the first end, the second distance being greater than the first distance, the first pressure space being equipped with a first connector for a first pneumatic control pressure, and the second pressure space being equipped with a second connector for a second pneumatic control pressure, whereby the second pneumatic control pressure is selectively different from the first pneumatic control pressure, and a third plunger having a third active plunger face facing a third pressure space and a rear surface facing the second pressure space, the third plunger being coaxially coupled to the second plunger, the third pressure space defined at the second end of the plunger section, and adapted to be loaded, via a third connector, with a third pneumatic control pressure;

a connecting line in the housing, which is between the third pressure space and the second pressure space, such that the third connector is connected to the second connector via the connecting line in the housing; and a screw element screwed into the connecting line prevents fluid communication between the third connector and the second connector;

whereby when a pressure difference between the first and third pressure space occurs, the valve switches and supplies the intensifier plunger that is connected with the second pneumatic control pressure, and wherein the third plunger face of the third plunger has substantially the same area as the second plunger face of the second plunger.

5. A valve for controlling a hydropneumatic device for pressure intensifying having a working plunger and an intensifier plunger for pressure intensifying, the intensifier plunger being adapted to move the working plunger hydraulically with a high transmission ratio by a pneumatic actuation, the valve comprising:

a housing having a plunger section, the plunger section having first and second ends defining an axis therebetween;

a slidable plunger rod coaxially mounted in the plunger section and reciprocally movable in a path of travel defined in a direction between the first and second ends of the plunger section;

a differential plunger arrangement including a first plunger mounted on the slidable plunger rod, having a first active plunger face and a rear surface, the first plunger face is facing a first pressure space defined at the first end of the plunger section, a second plunger, mounted on the slidable plunger rod and coaxially coupled to the first plunger, having a second active plunger face and a rear surface, the second plunger face is facing a second pressure space, the coaxially mounted first and second plungers being movable in the path of travel between a first position wherein the first plunger face facing the first pressure space is located proximate the first end, and the second plunger face facing the second pressure space is located at a first distance from the first end, and a second position wherein the first plunger face facing the first pressure space is spaced away from the first end, and the second plunger face facing the second pressure space is at a second distance from the first end, the second distance being greater than the first distance, the first pressure space being equipped with a first connector for a first pneumatic control pressure, and the second pressure space being equipped with a second connector for a second pneumatic control pressure, whereby the second pneumatic control pressure is selectively different from the first pneumatic control pressure, and a third plunger having a third plunger face facing a third pressure space and a rear surface facing the second pressure space, the third plunger being coaxially coupled to the second plunger, the third pressure space defined at the second end of the plunger section and adapted to be loaded via a third connector with a third pneumatic control pressure;

a connecting line in the housing, which is between the third pressure space and the second pressure space, such that the third connector is connected to the second connector via the connecting line in the housing; and a screw element screwed into the connecting line prevents fluid communication between the third connector and the second connector;

wherein the valve switches when a predefined pressure difference occurs between the first and third pressure spaces, and supplies the second pneumatic control pressure; and wherein the third plunger face of the third plunger has substantially the same outer diameter as the second plunger face of the second plunger.

6. A valve for controlling a hydropneumatics device for pressure intensifying having a working plunger and an intensifier plunger for pressure intensifying, the intensifier plunger being adapted to move the working plunger hydraulically with a high transmission ratio by pneumatic action, the valve comprising:

a housing having a plunger section, the plunger section having first and second ends defining an axis therebetween;

a slidable plunger rod coaxially mounted in the plunger section and reciprocally movable in a path of travel defined in a direction between the first and second ends of the plunger section;

a differential plunger arrangement including a first plunger, mounted on the slidable plunger rod, having a first active plunger face, the first plunger face is facing a first pressure space defined at the first end of the plunger section, and a first rear surface, a second plunger, mounted on the slidable plunger rod and coaxially coupled to the first plunger, having a second active plunger face, the second plunger face is facing a second pressure space, and a second rear surface separate and spaced away on the plunger rod from the first rear surface, the coaxially mounted first and second plungers being movable in the path of travel between a first position wherein the first plunger face is facing the first pressure space is located proximate the first end, and the second plunger face facing the second pressure space is located at a first distance from the first end, and a second position wherein the first plunger face facing the first pressure space is spaced away from the first end, and the second plunger face facing the second pressure space is at a second distance from the first end, the second distance being greater than the first distance, the first pressure space being equipped with a first connector for a first pneumatic control pressure, and the second pressure space being equipped with a second connector for a second pneumatic control pressure, whereby the second pneumatic control pressure is selectively different from the first pneumatic control pressure, and a third plunger having a third active plunger face facing a third pressure space and a third rear surface facing the second pressure space, the third plunger being coaxially coupled to the second plunger, the third pressure space defined at the second end of the plunger section, and adapted to be loaded, via a third connector, with a third pneumatic control pressure;

a connecting line in the housing, which is between the third pressure space and the second pressure space, such that the third connector is connected to the second connector via the connecting line in the housing; and a screw element screwed into the connecting line prevents fluid communication between the third connector and the second connector;

whereby when a pressure difference between the first and third pressure space occurs, the valve switches and supplies the second pneumatic control pressure; and wherein the third plunger face has substantially the same outer diameter as the second plunger face of the second plunger.

* * * * *